United States Patent [19]

Hemmat

[11] 4,433,474

[45] Feb. 28, 1984

[54] AMORPHOUS MAGNETIC CORE AND PROCESS FOR MANUFACTURING TO IMPROVE EFFICIENCY

[75] Inventor: Naim Hemmat, Mendham, N.J.

[73] Assignee: Electric Power Research Institute, Inc., Palo Alto, Calif.

[21] Appl. No.: 309,808

[22] Filed: Oct. 8, 1981

[51] Int. Cl.[3] ..... H01F 7/06

[52] U.S. Cl. ..... 29/605; 72/147; 148/108

[58] Field of Search ..... 29/605, 608, 609; 242/55, 67.1 R, 78.1; 72/46, 47, 146, 147; 148/103, 108

[56] References Cited

U.S. PATENT DOCUMENTS

| | | | |
|---|---|---|---|
| 2,914,840 | 12/1959 | Damiano | 29/605 |
| 3,227,544 | 1/1966 | Rowady . | |
| 3,606,676 | 9/1971 | Kohler | 29/605 |
| 3,726,005 | 4/1973 | Prostor | 29/605 |
| 3,856,513 | 12/1974 | Chen et al. . | |
| 4,095,557 | 6/1978 | Croop et al. | 29/605 |
| 4,262,233 | 4/1981 | Becker et al. . | |

*Primary Examiner*—John P. Sheehan

*Attorney, Agent, or Firm*—King and Liles

[57] ABSTRACT

A magnetic core with reduced losses is provided along with a related improvement in the process for fabricating magnetic cores for electromagnetic devices from strips of amorphous magnetic alloys. Magnetic powder, or magnetic powder mixed with a suitable carrier, is applied to the core for filling gaps occurring between the layers of the amorphous strips.

9 Claims, 3 Drawing Figures

AMORPHOUS MAGNETIC CORE AND PROCESS FOR MANUFACTURING TO IMPROVE EFFICIENCY

TECHNICAL FIELD

This invention relates to magnetic core structures and a process for manufacturing the same for use in electrical induction apparatus such as transformers, motors, generators and the like, and more specifically to manufacturing of such core structures formed of amorphous magnetic metal alloys.

BACKGROUND ART

Magnetic devices, such as transformers, motors, generators and the like typically include wound or layered core members composed of magnetic polycrystalline metal alloy. Alternatively, amorphous (i.e., noncrystalline, or glassy) magnetic metal alloys are now available for use in these devices. Such amorphous materials are described, for example, in Chen et al U.S. Pat. 3,856,513.

When used in wound cores, a continuous strip, ribbon,or tape of such a material is typically wound on a suitable mandrel and annealed to relieve winding stresses. The mandrel is then removed from the core, which is then cut and treated for receiving windings thereon.

One of the problems with magnetic core members of amorphous material formed according to the prior art processes is the core losses produced by the existence of voids, or spacing between the layers of the magnetic strips or tapes. Such voids increase transformer losses due to a low packing factor, i.e. reduced density of the magnetic core. This spacing effect, also known as the space factor, is more pronounced for magnetic tapes made from amorphous alloys since such materials may exhibit less cross-sectional rectangularity than the conventional crystalline tape material. For example, in the case of a transformer, the voltage (E) induced (or impressed) on a transformer winding is $E = 4{,}44\ BfNAS$ where:

B = peak working density of core material f = frequency

N = number of turns of winding

A = cross-sectional core area

S = space factor of core material

The above formula shows that the induced voltage is directly proportional to the space factor, i.e., as the space factor decreases (from unity), the induced voltage decreases. The peak working density B cannot be increased since it is fixed at a given percent of saturation density. Since the power capacity of a transformer is a function of the impressed or induced voltage squared, reduction in space factor seriously impairs the power capacity of the transformer. This loss could be compensated by increasing the iron and copper contents of the transformer. However, a better alternative wound be to improve the space factor. This is an especially desirable alternative for magnetic cores wound from amorphous magnetic strips since substantial improvement is possible. In some cases, the space-factor for amorphous strips can be as low as in the order of 0.8, compared to the conventional polycrystalline strips (e.g. silicon iron composition) which can have a space factor as high as 0.97.

DISCLOSURE OF INVENTION

It is accordingly an object of the present invention to overcome the deficiencies of the prior art, and to provide an improved magnetic core and process for manufacturing such magnetic cores.

It is a more specific object of the invention to provide an improved magnetic core and manufacturing process for magnetic cores formed of amorphous magnetic metal alloys.

It is still a further object of the invention to provide magnetic cores formed of amorphous material in which core losses due to interstitial gaps between layers of the amorphous material are reduced.

Still another object of the invention is the provision of magnetic cores in which a magnetic powder is placed within voids between layers of magnetic material used to fabricate the cores.

In accordance with the foregoing objects, the present invention provides a product and process for increasing the operating efficiency (power capacity) of electromagnetic devices having amorphous cores by reducing magnetic losses associated with voids formed between the layers of the cores. The increased efficiency is a result of a step in the fabrication process of the cores in which a plurality of layers of a strip of magnetically permeable material are wound to form the core. In the inventive process, material, having magnetic properties similar to that of the strip used to form the core, is embedded between the strip layers. Preferably, the material is provided in the form of a powder and is the same composition as the strip. The powder may also be mixed with a suitable carrier, to be used in the form of a slurry to enhance its distribution and retention within the tape layers.

BRIEF DESCRIPTION OF DRAWINGS

These and other objects, features and advantages of the invention will become more readily apparent upon reference to the following detailed description of the preferred embodiment in conjunction with the accompanying drawings, in which.

BEST MODE FOR CARRYING OUT THE INVENTION

Figure 1:
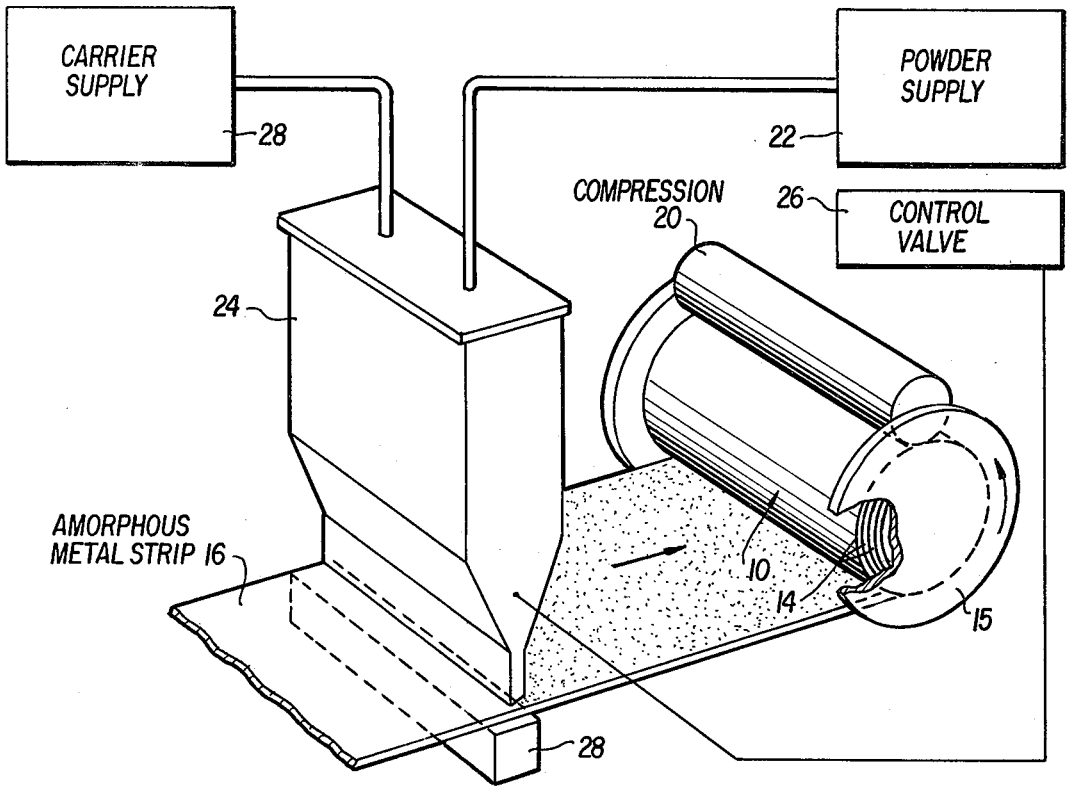
FIG. 1 is a perspective view of an apparatus for carrying out a winding process including the improvement of the present invention.
Figure 2:
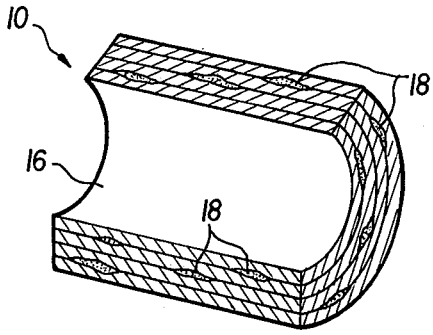
FIG. 2 is an enlarged perspective view, partially in cross section, of a portion of the core of the invention produced by the apparatus of FIG. 1.

Referring to FIGS. 1 and 2 of the drawing, there is shown generally at 10 a portion of a wound core of a magnetic device formed in accordance with the present invention. The magnetic core 10 comprises a plurality of magnetic layers 14 wound on a conventional mandrel 15. The layered core 10 is formed by winding a strip 16 of amorphous magnetic material as illustratively shown in FIG. 1. The layers 14 are compressed together to form the core 10. Layers 14 are seen to be separated from each other by a number of intervening voids interposed between the layers at several interstitial locations 18 (see FIG. 2).

Voids may also occur in cores formed of conventional, polycrystalline magnetic strip materials. However, the fact that amorphous material is inherently more efficient in operation as a magnetic core for an electromagnetic device, the invention applies with more importance to amorphous magnetic cores. Also, because at present the manufacturing process for amorphous material is difficult to carry out and is not perfected, the amorphous material may exhibit less rectangularity than the crystalline material, thus leading to undesirable interstitial voids. The voids 18 are shown highly enlarged in FIG. 2 for illustrative purposes.

The amorphous metal strip 16 is typically an alloy composition containing at least about 50% amorphous structure, as determined by x-ray diffraction. These alloys include those having the formula $$M_{60-90}T_{0-15}X_{10-25}$$

wherein M is at least one of the elements iron, cobalt and nickel, wherein T is at least one of the transition metal elements, and X is at least one of the metalloid elements of phosphorous, boron and carbon. Up to 80 percent of the carbon, phosphorus and/or boron in X may be replaced by aluminum, antimony, beryllium, germanium, indium, silicon and tin. Used as cores of magnetic devices, such amorphous metal alloys evidence generally superior physical and electrical properties as compared to the conventional polycrystalline metal alloys commonly utilized. Preferably, strips of such amorphous alloys are at least about 80% amorphous, more preferably yet, at least about 95% amorphous.

The amorphous magnetic alloys of which strip 16 is preferably composed are formed by cooling a molten alloy at a rate of about $10^5$ to $10^{6°}$ C./sec. The rapid quench rate required leads to the difficulty of maintaining the constant thickness and the cross-sectional uniformity of the strip 16 required to completely eliminate voids in the wound core 10.

Known techniques are available for casting the rapid-quenched continuous strip. The strip 16 is typically prepared by casting molten material of the required thickness directly onto a rapidly moving chill surface, such as a rotating wheel or endless belt. Such a casting technique provides a strip 16 of high quality requiring no intermediate drawing or other forming procedures. While substantial advances have been made toward perfecting these processes, the need for the present invention has arisen due to the inability at the present time to completely eliminate presence of voids in a wound core.

The amorphous metal alloys of which strip 16 is preferably composed evidence high tensile strength, typically about 200,000 to 600,000 psi, depending on the particular composition. This is to be compared with polycrystalline alloys, which are used in the annealed condition and which usually range from about 40,000 to 80,000 psi. A high tensile strength is an especially important consideration in applications where the core is subjected to high centrifugal forces, such as experienced by cores in motors and generators, since higher strength alloys allow higher rotational speeds.

In addition, the amorphous metal alloys used to form strip 16 evidence a high electrical resistivity, ranging from about 160 to 180 microhm-cm. The high resistivity possessed by the amorphous metal alloys is useful in AC applications for minimizing eddy current losses, which, in turn, are a factor in reducing core loss.

A further advantage of using amorphous metal alloys to form strip 16 is that lower coercive forces are obtained than with prior art compositions of substantially the same metallic content, thereby making possible the use of more iron, which is relatively inexpensive, to be utilized in the strip 16 as compared with a greater proportion of nickel, which is more expensive.

Still further, the fabricability and ductility of the amorphous metal alloys are good. In the prior art, mechanical treatment, such as punching and stamping, tends to degrade magnetic properties. This degradation must be overcome with additional thermal treatment. In amorphous metal alloys used in accordance with the invention, the magnetic properties do not change and in fact, slightly improve in many cases through such treatment.

As seen in the drawings, the magnetic core element 10 is formed by winding successive turns of strip 16 on the mandrel 15. During winding of successive turns, strip 16 is kept under sufficient tension to effect tight formation of the core element 10. Optionally, a compression means such as roller(s) 20 may be used to assure firm engagement of each successive turn of the strip 16 on the core element 10, as seen in FIG. 1. The number of turns required for a given core can range from a few turns to several thousand turns, depending upon the power capacity of the electromagnetic device desired. When the required number of turns are wound, the strip 16 is cut across the width thereof, the outer turn being held in wound relation to the preceding turn. When sufficient turns have been wound to form a given magnetic core element as above described, the mandrel is removed therefrom to produce the core.

Amorphous metal strip is relatively thin as compared to rolled crystalline strip. Coupled with the improved magnetic properties and higher tensile strength, the core element 10 can be wound at lower construction, processing and material costs than other magnetic cores. However, as previously described herein, the gaps that may form between the layers of the thin amorphous strip have a deleterious effect in the form of increased core losses. Thus, in order to minimize such losses and in accordance with the present invention, a powder consisting of magnetic particles is spread onto each layer of the wound core to fill the voids. The magnetic powder is preferably dispensed from powder supply 22 through dispensing nozzle 24. The powder of magnetic material is spread on the strip 16 being wound on the most recently compressed layer 14 of the core element 10 (see FIG. 1). To control the powder being deposited by the nozzle 24, a control valve 26 is provided. The valve 26 is preferably infinitely variable in order to control the amount of powder being dispensed onto the strip 16.

A carrier is provided for the powder by source 28. The carrier may be a dry fluid, such as air. The magnetic powder may also be united with a suitable carrier liquid to form a slurry, with the powder grains preferably being in the range of $10^{-6}$ to $10^{-4}$ inch.

The desired characteristics of a preferred liquid carrier include:

(a) the ability to wet the surface of the metal strip;
(b) sufficiently low viscosity to promote a high packing factor of powder particles within the mix, and of the slurry within the layers; and
(c) the capability of stiffening or solidifying at low temperature in order to retain the mix in position between the wound amorphous metallic layers.

An exemplary suitable carrier is known in the trade as Magnetic Cement, as manufactured by G. C. Electronics, of Rockport, Ill., and designated as part 38—2.

The powder supply 22 and the carrier supply 28 are provided under sufficient pressure for dispensing the mixture onto the core 10. Where air, or another gaseous fluid is used as the carrier,the supply pressure is kept sufficiently high to effect the powder from the nozzle 24, but sufficiently low to maintain the ejected powder on the strip; i.e., the pressure is controlled to avoid providing excessively high kinetic energy to the powder particles that would cause the powder to be blown off the strip. Deposition and/or retention of filler material may also be aided by application of a magnetic field to the strip and/or the core such as by magnetic field generator 28. The application of a magnetic field also aids in alignment of the magnetic powder on the strip 16.

The magnetic powder is thus introduced into, embedded and retained within the gaps between the layers 14, thus eliminating or reducing the voids in the core structure, and the associated operating core losses.

Figure 3:
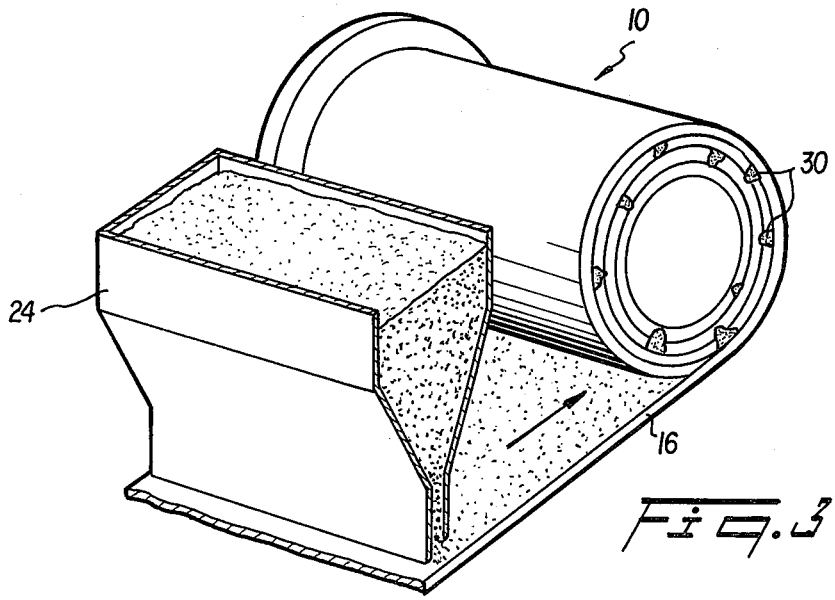
FIG. 3 is an enlarged view of apparatus for carrying out the invention.

As each layer 14 of amorphous strip 16 is wound onto the core, the magnetic powder is compressed into the voids at 18, by means of tension on the strip as it is being wound or, optionally, by means of applied pressure, correcting the deficiencies. Any excessive magnetic powder or slurry is squeezed from between the layers 14 by the applied tension and/or compression, as illustrated by the excess material 30 in FIG. 3.

An alternative manner of applying the powder to the interstitial gaps in accordance with the broadest aspects of the invention is to provide pressurization of the powder or slurry against the sides of the completely wound structure, thus forcing the same into the voids subsequent to winding. A still further alternative is to apply the powder or the slurry to the strip 16 prior to the winding of the core 10.

It is further appreciated that the present method may be applied to cores formed of stacks of layers, rather than a continuously wound layer, formed of amorphous alloy. In such stacked cores, each layer may be coated with the dry powder or slurry prior to, during or subsequent to the stacking process, as described above.

Construction of a transformer incorporating the core 10 can readily be effected by toroidal winding of primary and secondary turns of suitable high conductivity wire or ribbon about the core 10. The elimination of intestitial voids afforded by the present construction of core 10 substantially reduces the loss associated with the apparatus (e.g. transformer) utilizing the core.

The preceding specification describes, by way of illustration and not of limitation, a preferred embodiment of the invention. It is appreciated that equivalent variations of the invention will occur to those skilled in the art. Such modifications, variations and equivalents are within the scope of the invention as recited with greater particularity in the appended claims, when interpreted to obtain the benefits of all equivalents to which the invention is fairly and legally entitled.

I claim:

1. In a method for winding magnetic cores for electromagnetic devices including the step of winding a strip of magnetic material in layers to form the core, the improvement comprising the step of filling interstitial gaps between successive layers of said magnetic material with a filler of magnetically permeable powder.

2. The method of claim 1 wherein said filling step includes the step of dispensing said powder on said strip prior to said winding step.

3. The method of claim 1 wherein said filling step includes the steps of mixing said powder with a carrier, and dispensing the mixture to contact said strip.

4. The method of claim 3 wherein said dispensing step includes the step of depositing said mixture on said strip prior to the winding step, said dispensing step being followed by the step of winding the coated strip to form a layer of magnetic material.

5. The method of claim 4 further comprising the step of embedding the mixture into the intestitial gaps by compressing each subsequent layer against the previously wound layer.

6. A method for winding magnetic cores for electromagnetic devices including the steps of:

winding a a strip of amorphous metal alloy into a plurality of layers of said core, and filling intestitial gaps between succeeding layers of said amorphous metal alloy with material having magnetic properties similar thereto.

7. The method of claim 6 wherein said filling step includes the steps of mixing magnetic powder with a carrier and dispensing the mixture to contact a previously wound layer of amorphous magnetic alloy.

8. The method of claim 7 wherein said powder is formed of substantially the same composition as said strip of amorphous metal alloy.

9. The method of claim 7 wherein a magnetic field is applied to said strip to assist in retention and alignment of the magnetic powder.

* * * * *